US009663208B1

(12) United States Patent
Blavat

(10) Patent No.: US 9,663,208 B1
(45) Date of Patent: May 30, 2017

(54) PADDLE HOLDER

(71) Applicant: Michael A. Blavat, Marinette, WI (US)

(72) Inventor: Michael A. Blavat, Marinette, WI (US)

( * ) Notice: Subject to any disclaimer, the term of this patent is extended or adjusted under 35 U.S.C. 154(b) by 0 days.

(21) Appl. No.: 15/206,733

(22) Filed: Jul. 11, 2016

Related U.S. Application Data

(60) Provisional application No. 62/194,966, filed on Jul. 21, 2015.

(51) Int. Cl.
*B63H 16/06* (2006.01)
*B63B 35/71* (2006.01)

(52) U.S. Cl.
CPC ..... *B63H 16/06* (2013.01); *B63B 35/71* (2013.01); *B63B 2035/715* (2013.01)

(58) Field of Classification Search
CPC ..... B63B 17/00; B63B 35/00; B63H 16/06
USPC ..... 114/364; 440/104
See application file for complete search history.

(56) References Cited

U.S. PATENT DOCUMENTS 6,027,387 A * 2/2000 Allin ..... B63B 17/00 114/364
7,527,012 B2 * 5/2009 Kutny Splaine ..... B63B 25/002 114/364
8,480,045 B2 * 7/2013 Adams, IV ..... F16B 45/00 248/205.5
8,915,207 B2 * 12/2014 Wirsig ..... B63B 39/00 114/364
9,499,235 B1 * 11/2016 Blavat ..... B63B 17/00

* cited by examiner

*Primary Examiner* — Lars A Olson
(74) *Attorney, Agent, or Firm* — Donald J. Ersler

(57) ABSTRACT

A paddle holder includes a handle retention clip and a suction cup. The handle retention clip includes a lengthwise body and a pair of opposing lips. The lengthwise body includes an inner perimeter, which is sized to receive a handle of a paddle. The pair of opposing lips extend inward from opposing edges of the lengthwise body. The suction cup includes a suction cup portion and a mounting portion. The suction cup portion is retained on the mounting portion. The mounting portion is attached to the handle retention clip with two fasteners. The suction cup is preferably a twist lock suction cup. In use, the at least one suction cup is secured to a flat surface on a kayak, paddle board or the like.

20 Claims, 6 Drawing Sheets

PADDLE HOLDER

CROSS-REFERENCES TO RELATED APPLICATIONS

This is a utility patent application taking priority from provisional application No. 62/194,966 filed on Jul. 21, 2015.

BACKGROUND OF THE INVENTION

1. Field of the Invention

The present invention relates generally to water vessels and more specifically to a paddle holder, which uses a suction cup for securing a paddle to a body of a kayak, a paddle board or the like instead of fasteners.

2. Discussion of the Prior Art

It is well known in the art to secure a paddle to a kayak with a paddle holder. However, the paddle holder is presently secured to a body of the kayak with fasteners. Using fasteners requires that holes be drilled through the body of the kayak to secure the paddle holder. However, drilling holes may damage the structural integrity of the kayak or allow water to enter the kayak at a later date.

Accordingly, there is a clearly felt need in the art for a paddle holder, which retains a paddle on a kayak, paddle board or the like without the necessity of drilling holes therethrough for attachment of the paddle holder with fasteners.

SUMMARY OF THE INVENTION

The present invention provides a paddle holder, which retains a paddle on kayak, paddle board or the like without the necessity for attachment with fasteners. The paddle holder includes a handle retention clip and a suction cup. The handle retention clip includes a lengthwise body and a pair of opposing lips. The lengthwise body includes an inner perimeter, which is sized to receive a handle of a paddle. A pair of cup bosses are preferably formed on a bottom of the lengthwise body in substantially a middle thereof. A fastener hole is formed through each cup boss. The inner perimeter preferably has a substantially semi-circular shape. The pair of opposing lips extend inward from opposing edges of the lengthwise body. Each suction cup includes a suction cup portion and a mounting portion. The suction cup portion is retained by the mounting portion. Two fasteners are inserted through the two fastener holes and the handle retention clip is secured to the mounting portion with the two fasteners. The suction cup is preferably a twist lock suction cup.

In use, the suction cup is secured to a flat surface on a kayak, paddle board or the like. If the twist lock suction cup is used, twist levers thereof are rotated to lock the twist lock suction cup to the flat surface. The handle of the paddle is then snapped into the handle retention clip and retained by the pair of opposing lips.

Accordingly, it is an object of the present invention to provide a paddle holder, which retains a paddle on a kayak, paddle board or the like without the necessity of drilling holes therethrough for attachment of the paddle holder with fasteners.

These and additional objects, advantages, features and benefits of the present invention will become apparent from the following specification.

DETAILED DESCRIPTION OF THE PREFERRED EMBODIMENTS

Figure 1:
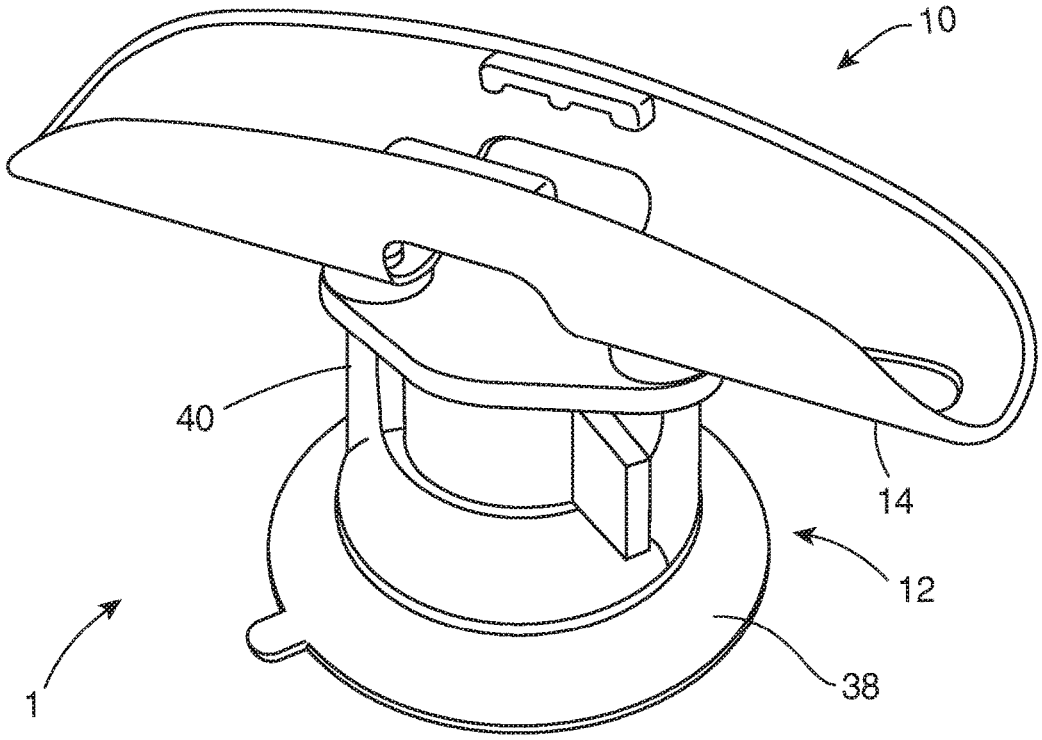
FIG. 1 is a perspective view of a paddle holder in accordance with the present invention.
Figure 2:
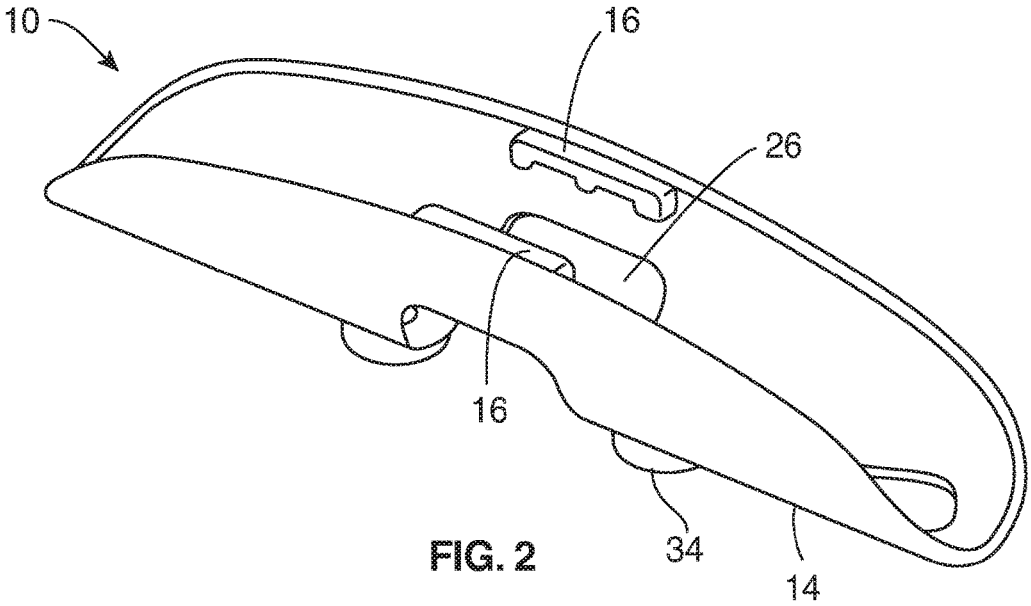
FIG. 2 is a top perspective view of a handle retention clip of a paddle holder in accordance with the present invention.
Figure 3:
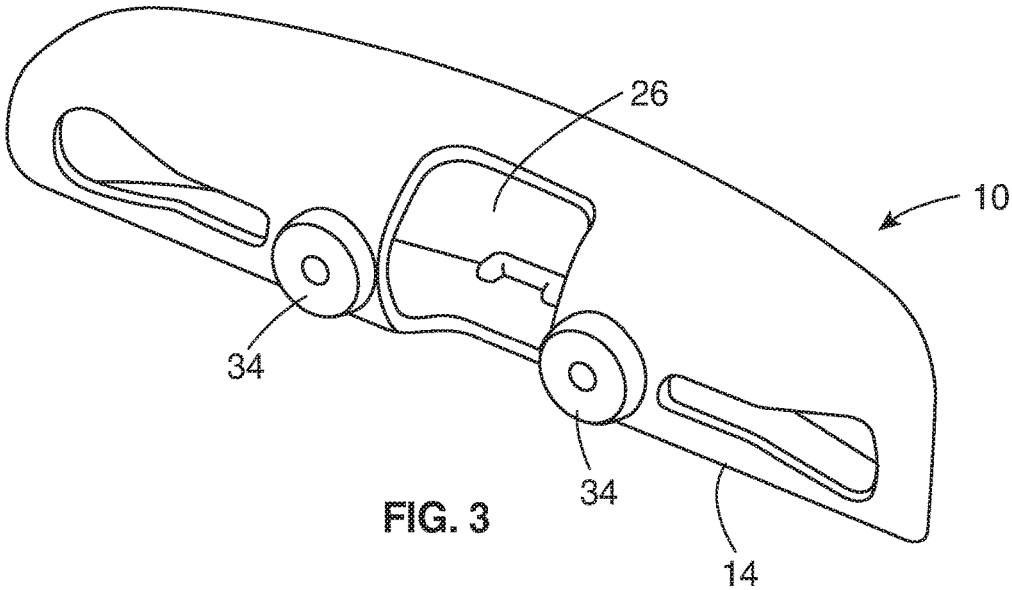
FIG. 3 is a bottom perspective view of a handle retention clip of a paddle holder in accordance with the present invention.
Figure 4:
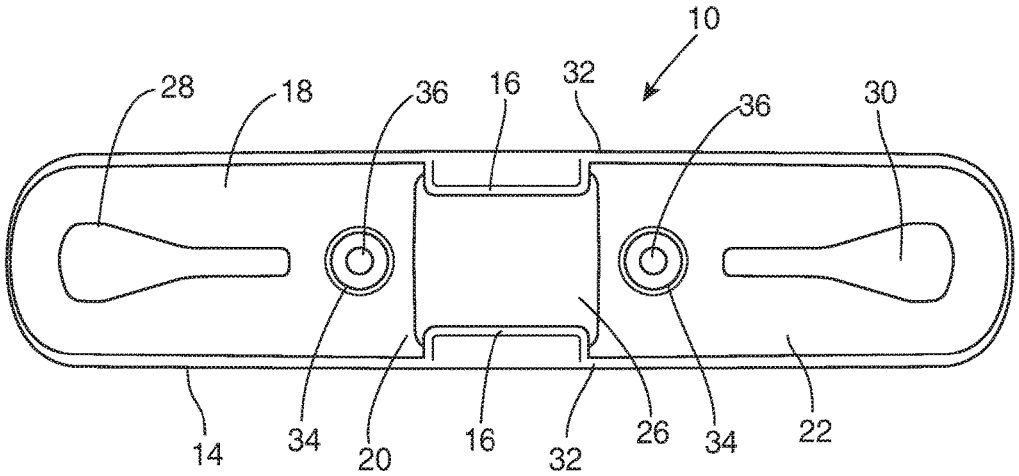
FIG. 4 is a top view of a handle retention clip of a paddle holder in accordance with the present invention.
Figure 5:
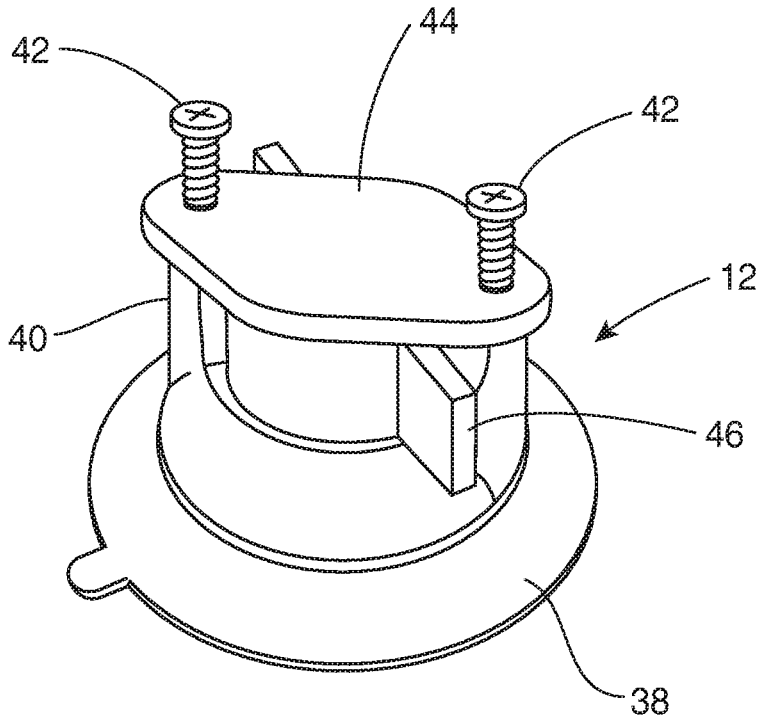
FIG. 5 is a top perspective view of a twist lock suction cup of a paddle holder in accordance with the present invention.
Figure 6:
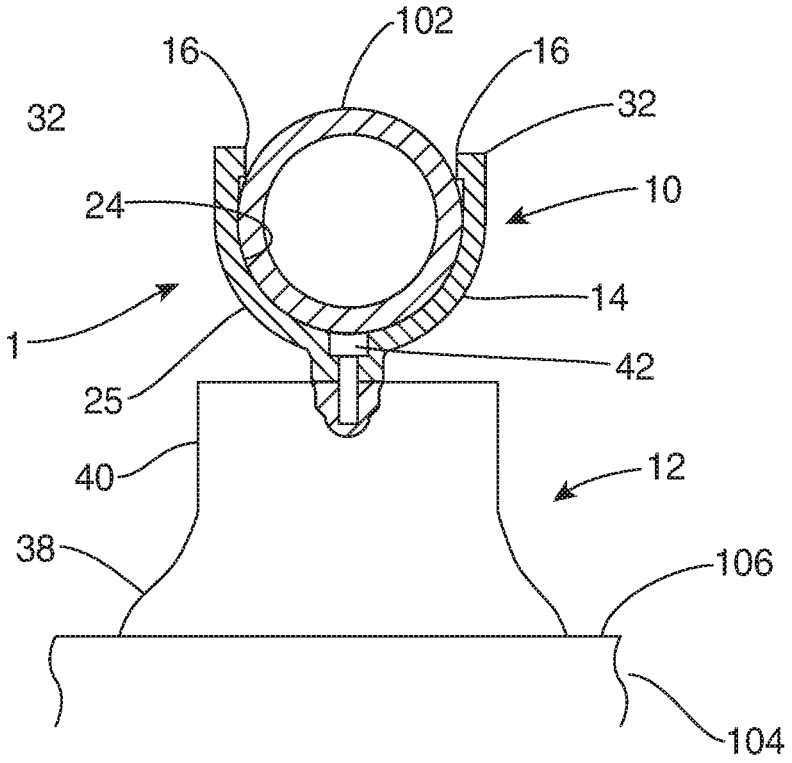
FIG. 6 is a cross sectional view of a handle of a paddle retained in a paddle holder in accordance with the present invention.

With reference now to the drawings, and particularly to FIG. 1, there is shown a perspective view of a paddle holder 1. With reference to FIGS. 2-5, the paddle holder 1 includes a handle retention clip 10 and a suction cup 12. The handle retention clip 10 includes a lengthwise body 14 and a pair of opposing lips 16. The lengthwise body 14 includes a first support portion 18, a clip portion 20 and a second support portion 22. The first support portion 18 extends from a first end of the clip portion 20 and the second support portion 22 extends from a second end of the clip portion 20. The clip portion 20 and the first and second support portions 18, 22 include an inner perimeter 24, which is sized to receive a handle of a paddle. With reference to FIG. 6, a cross section of the inner perimeter 24 preferably has a substantially semi-circular shape. The lengthwise body 14 preferably has a substantially uniform wall thickness with an outer perimeter 25.

Figure 7:
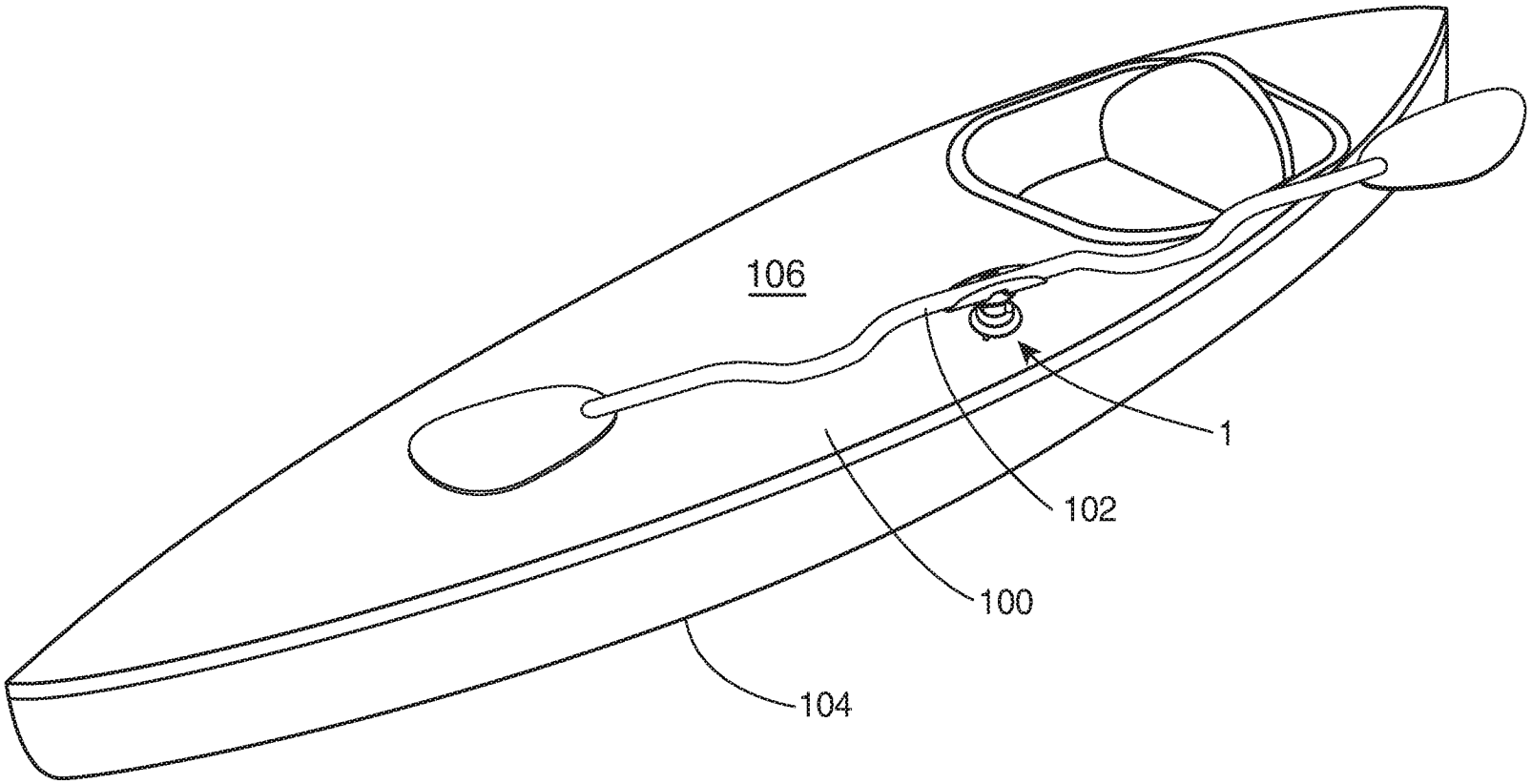
FIG. 7 is a paddle holder attached to a kayak in accordance with the present invention.

A material reduction opening 26 is preferably formed through the clip portion 20 to increase flexibility and to decrease the amount of material required in the lengthwise body 14. A first support opening 28 is preferably formed through the first support portion 18 and the second support opening 30 is formed through the second support portion 22. The pair of opposing lips 16 extend inward toward each other from opposing edges 32 of the clip portion 20. A length of the pair of opposing lips 16 is preferably substantially equal to a width of the substantially semi-circular shape. A pair of cup bosses 34 are preferably formed on a bottom of the lengthwise body 14, adjacent opposing ends of the material reduction opening 26. A fastener hole 36 is formed through each cup boss 34. With reference to FIG. 7, the handle retention clip 10 is preferably fabricated from a flexible plastic material having memory properties to allow a handle 102 of a paddle 100 to be inserted past the pair of opposing lips 16 and retained by the pair of opposing lips 16.

Each suction cup 12 includes a suction cup portion 38 and a mounting portion 40. The suction cup portion 38 is retained by the mounting portion 40. Suction cups are well known in the art and need not be explained in further detail. Two fasteners 42 are inserted through the two fastener holes 36 and the handle retention clip 10 is secured to the mounting portion 40 with the two fasteners 42. A cover plate 44 may be retained between the handle retention clip 10 and the mounting portion 40. The suction cup 12 is preferably a twist lock suction cup. The mounting portion 40 of the twist lock suction cup includes a lock lever 46. With reference to FIG. 7, the suction cup 12 is secured to a flat surface 106 on a kayak 104. The handle 102 of the paddle 100 is then snapped into the handle retention clip 10 and retained in the inner perimeter 24 by the pair of opposing lips 16.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A paddle holder comprising:

a handle retention clip includes a lengthwise body and a pair of opposing lips, said lengthwise body includes an outer perimeter and an inner perimeter, a cross section of said inner and outer perimeters having a substantially semi-circular shape, said lengthwise body includes a first support portion, a clip portion and a second support portion, said first support portion extends from a first end of said clip portion, said second support portion extends from a second end of said clip portion, said pair of opposing lips extend inward from opposing edges of said clip portion, said inner perimeter is sized to receive a handle of a paddle, a material reduction opening is formed through said clip portion directly below said pair of opposing lips, wherein said first and second support portions are capable of making contact with the handle; and at least one suction cup, each one of said at least one suction cup includes a suction cup portion and a mounting portion, said mounting portion is secured to a bottom of said lengthwise body.

2. The paddle holder of claim 1 wherein:

a pair of cup bosses are formed on a bottom of said handle retention clip adjacent opposing ends of said material reduction opening.

3. The paddle holder of claim 2 wherein:

a fastener hole is formed through each one of said pair of cup bosses for insertion of a fastener.

4. The paddle holder of claim 1, further comprising:

said mounting portion is attached to said retention clip with two fasteners.

5. The paddle holder of claim 1 wherein:

said suction cup is a twist lock suction cup, said mounting portion includes a lock lever.

6. The paddle holder of claim 1, further comprising:

a cover plate is retained between said handle retention clip and said mounting portion.

7. The paddle holder of claim 1 wherein:

a length of said pair of opposing lips is substantially equal to a width of said substantially semi-circular shape.

8. A paddle holder comprising:

a handle retention clip includes a lengthwise body and a pair of opposing lips, said lengthwise body includes an outer perimeter and an inner perimeter, a cross section of said inner and outer perimeters having a substantially semi-circular shape, said lengthwise body includes a first support portion, a clip portion and a second support portion, said first support portion extends from a first end of said clip portion, said second support portion extends from a second end of said clip portion, said pair of opposing lips extend inward from opposing edges of said clip portion, said inner perimeter is sized to receive a handle of a paddle, a material reduction opening is formed through said clip portion directly below said pair of opposing lips, wherein said first and second support portions are capable of making contact with the handle, said handle retention clip is fabricated from a flexible material having memory properties; and at least one suction cup, each one of said at least one suction cup includes a suction cup portion and a mounting portion, said mounting portion is secured to a bottom of said lengthwise body.

9. The paddle holder of claim 8 wherein:

a pair of cup bosses are formed on a bottom of said handle retention clip adjacent opposing ends of said material reduction opening.

10. The paddle holder of claim 9 wherein:

a fastener hole is formed through each one of said pair of cup bosses for insertion of a fastener.

11. The paddle holder of claim 8, further comprising:

said mounting portion is attached to said retention clip with two fasteners.

12. The paddle holder of claim 8 wherein:

said suction cup is a twist lock suction cup, said mounting portion includes a lock lever.

13. The paddle holder of claim 8, further comprising:

a cover plate is retained between said handle retention clip and said mounting portion.

14. The paddle holder of claim 8 wherein:

a length of said pair of opposing lips is substantially equal to a width of said substantially semi-circular shape.

15. A paddle holder comprising:

a handle retention clip includes a lengthwise body and a pair of opposing lips, said lengthwise body includes an outer perimeter and an inner perimeter, a cross section of said inner and outer perimeters having a substantially semi-circular shape, said lengthwise body includes a first support portion, a clip portion and a second support portion, said first support portion extends from a first end of said clip portion, said second support portion extends from a second end of said clip portion, said pair of opposing lips extend inward from opposing edges of said clip portion, said inner perimeter is sized to receive a handle of a paddle, a material reduction opening is formed through said clip portion directly below said pair of opposing lips, wherein said first and second support portions are capable of making contact with the handle, substantially all of a portion of the handle is not supported directly below said pair of opposing lips by said handle retention clip; and at least one suction cup, each one of said at least one suction cup includes a suction cup portion and a mounting portion, said mounting portion is secured to a bottom of said lengthwise body.

16. The paddle holder of claim 15 wherein:

a pair of cup bosses are formed on a bottom of said handle retention clip adjacent opposing ends of said material reduction opening.

17. The paddle holder of claim 16 wherein:

a fastener hole is formed through each one of said pair of cup bosses for insertion of a fastener.

18. The paddle holder of claim 14 further comprising:

said mounting portion is attached to said retention clip with two fasteners.

19. The paddle holder of claim 14 wherein:

said suction cup is a twist lock suction cup, said mounting portion includes a lock lever.

20. The paddle holder of claim 14, further comprising:

a cover plate is retained between said handle retention clip and said mounting portion.

* * * * *